United States Patent [19]

Chibret et al.

[11] Patent Number: 4,986,322

[45] Date of Patent: Jan. 22, 1991

[54] SYSTEM OF PACKAGING FOR READY TO USE PREPARATIONS

[75] Inventors: Jean Chibret, Cannes; Charles Manni, Principaute de Monaco, both of France

[73] Assignee: Societe Semco, Monaco, France

[21] Appl. No.: 418,713

[22] Filed: Oct. 3, 1989

Related U.S. Application Data

[63] Continuation of Ser. No. 142,923, Jan. 12, 1988, abandoned.

[30] Foreign Application Priority Data

Mar. 24, 1987 [FR] France ..... 87 04195
Jul. 29, 1987 [FR] France ..... 87 10864

[51] Int. Cl.[5] ..... B65D 81/32

[52] U.S. Cl. ..... 141/319; 141/25; 141/329; 141/363; 141/366; 141/386; 206/219; 215/DIG. 8

[58] Field of Search ..... 141/319, 320, 329, 330, 141/25, 26, 27, 363–366, 383–386; 206/219, 222; 215/DIG. 8

[56] References Cited

U.S. PATENT DOCUMENTS

| | | | |
|---|---|---|---|
| 2,957,609 | 10/1960 | Holmes | 141/330 X |
| 3,592,245 | 7/1971 | Schneller et al. | 141/25 |
| 3,917,063 | 11/1975 | Chibret et al. | 141/329 X |
| 4,573,506 | 3/1986 | Paoletti | 141/27 X |
| 4,576,211 | 3/1986 | Valentini et al. | 141/329 |
| 4,607,671 | 8/1986 | Aalto et al. | 141/329 |
| 4,872,494 | 10/1989 | Coccia | 141/383 |

FOREIGN PATENT DOCUMENTS

| | | | |
|---|---|---|---|
| 3152033 | 7/1983 | Fed. Rep. of Germany | 141/114 |
| 2302134 | 9/1976 | France | 141/329 |

*Primary Examiner*—Ernest G. Cusick
*Attorney, Agent, or Firm*—Frishauf, Holtz, Goodman & Woodward

[57] ABSTRACT

An assembly in-situ preparation of suspensions and solutions of an active, solid, product in a liquid product, each of the products being separately contained in a hermetic flask, with connecting means permitting the placing in communication of the two flasks, which means consists of a single piece (1) molded of plastic material with an upper portion (2) internally threaded for coupling with the neck of the flask (7) containing the liquid and a lower portion (3) capping the neck of the flask containing the solid product, the molded connecting piece is closed by a sealed elastomer stopper and an inner shoulder hooking over one or several small collars on the neck.

4 Claims, 2 Drawing Sheets

SYSTEM OF PACKAGING FOR READY TO USE PREPARATIONS

This application is a continuation of application Ser. No. 07/142,923, filed Jan. 12, 1988, abandoned.

BACKGROUND OF THE INVENTION

The present invention concerns assemblies for preparing ready to use suspensions or solutions of an active product, such as those described in U.S. Pat. No. 3,917,063.

Such an assembly includes two hermetically closed containers or flasks, one containing an active product generally under the form of a lyophilized dry powder, and the second containing the liquid in which the active product is put in solution or in suspension at the moment of administration. The assembly also has connection means permitting the putting in communication of the two flasks in two steps First the liquid is introduced in the first flask; then the solution or suspension thus formed is aspirated into the second flask.

To that effect, the first flask is generally of glass and is closed by an elastic stopper inserted in its neck and having in its axis a channel covered by a thin, perforable airtight membrane, glued or welded over one side; while the second flask, made of compressible material is closed by a dropper whose extremity has a diameter slightly smaller than that of the preceding channel. In order to allow the assembling and the putting in communication of the two flasks, the mouth of the first flask is surmounted by a socket, which can be internally threaded, or smooth, whereas the second flask possesses a cylindrical threaded part which can be screwed in the socket of the first flask.

Operation of this assembly consists in screwing the second flask in the socket of the first flask in such a manner that the dropper perforates the membrane when it empties into the first flask, thus providing airtightness between the two flasks.

When the second flask is compressed, liquid passes into the first flask; by shaking the assembly, a suspension or solution is formed and on reversing the assembly and relaxing the pressure on the second flask, the solution or suspension is caused to return into the second flask, where it is easy close by placing a stopper on the dropper.

According to one embodiment described in the aforementioned US patent, the base of the threaded socket has an external rim of the same diameter as that of the airtight membrane, and this socket is fixed on the flask by means of a setting metallic ring, resting on the upper side over this rim and on the lower side on the small collar of the first flask Such an assembly has many drawbacks. In the first place, to fix the socket on the first flask requires two distinct pieces, the socket itself, generally of plastic material, and a metallic setting ring. The socket simply resting on top of the rubber stopper demands a delicate centering. The setting of the ring itself represents a separate operation which prevents the setting in series of the different elements of the flask continuously on a single machine. This results in a high cost of production for the pieces and long assembly time.

SUMMARY OF THE INVENTION

The invention aims at a new mode of making an assembly by eliminating therefrom such drawbacks by simplifying the preceding elements.

To this effect, in accord with a characteristic of the invention, the aforesaid socket and the setting ring are formed of only one piece molded in plastic material which covers the neck of the first flask and which by a simple push is fitted on the aforesaid neck.

The single piece is put in place without any centering problem, and it is immobilized without any need of a separate setting operation. The number of pieces and setting operations are therefore limited, which represents an economy both of material and of time.

To prevent the rotation of the socket at the moment of screwing and of unscrewing, the invention provides vertical ribs under the small meshing collar of the rigid flask.

According to a first embodiment of this invention, the means of closing the flask containing the solid product remains as in the classic system, a stopper of elastomer plastic material, driven into the neck of the flask and pierced by a hole closed by an airtight perforable membrane. As will be described hereinafter, this arrangement ensures perfect airtightness of the system.

According to a second embodiment, the closing of the flask containing the solid product does not require the presence of a cork driven into the neck of this flask, but results solely from the presence of a membrane or film susceptible of being perforated, broken or cut across by the dropper at the moment of screwing the second flask into the connecting piece.

This membrane, which in the previous embodiment constituted an individual element placed over the closed stopper, can according to this second embodiment be a single piece molded with the connecting piece, especially in the intermediary zone between the upper threaded portion and the meshed lower portion. It also can be glued over the upper surface of the neck of the first flask.

It can be simply constituted by a disc of constant thickness sufficiently thin to be perforated by the dropper. It could equally include a central rupture zone, optionally reinforced by a brace.

It can equally be made of a material sufficiently elastic manufactured with a perforated passage which can return to its initial form; that is to say, remain airtight.

This modification offers the advantages over the previous one of simplicity and economy, because it completely eliminates the stopper of elastomeric material and its airtight membrane, as well as the setting operation of this stopper in the second flask before placing the connecting piece.

However, since such a closure means can present the risk of not being perfectly airtight, it should be realized that perfect sealing of the system requires meshing as tightly as possible of the connecting piece.

In any case, implementation of this embodiment is practically identical to that of the previous one, the communication between the two flasks being simply obtained by piercing the closure of the connecting piece instead of that of the membrane of the stopper.

BRIEF DESCRIPTION OF THE DRAWINGS

The invention is described in a non-limiting fashion with reference to the accompanying drawing in which.

DESCRIPTION OF PREFERRED EMBODIMENTS

Figure 1:
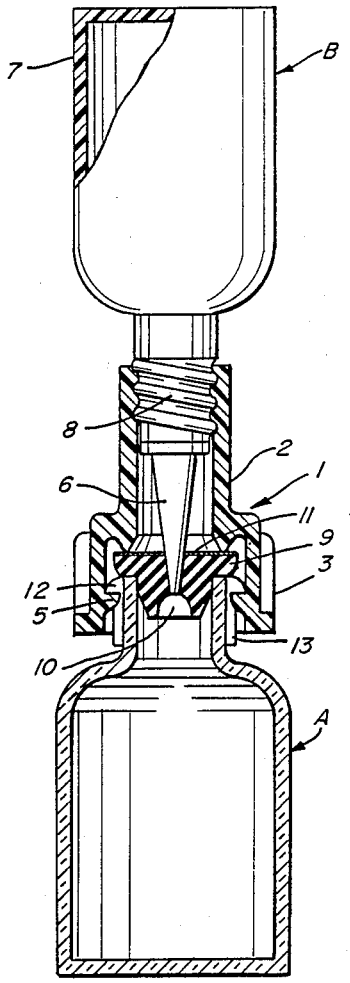
FIG. 1 represents in an axial cross-section, an assembly in accordance with the first embodiment of the invention.
Figure 2:
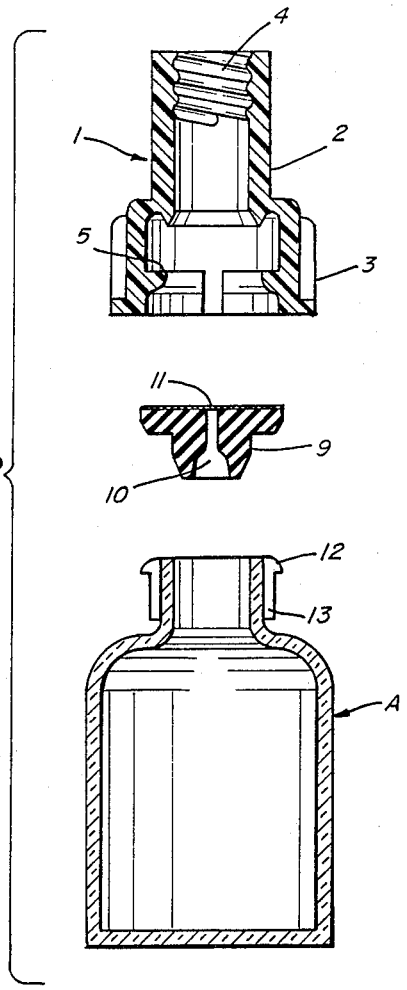
FIG. 2 is an exploded view of the elements of the first flask.

Referring descriptively to FIGS. 1 and 2, a second flask B is turned over and screwed into the socket connector 1 of the first flask A. This socket connector includes upper part 2, presenting an interior thread 4, and a lower part 3 presenting an inner shoulder 5.

In a known manner, flask B ends in a dropper 6, connected to the body 7 of the flask by a sleeve having an external thread 8. In the same way, the flask A is closed up a stopper 9 of elastomer material having a longitudinal hole 10, closed by an airtight rupturable closing means such as a perforable membrane 11, for example an aluminum polyethylene complex.

When the flask B is screwed on flask A by cooperation of the threads 4, and 8, the dropper 6 perforates and ruptures the membrane 11, and empties into the hole 10, placing in communication the two flasks.

According to the invention, the connection between the two flasks is accomplished by means of a single socket connector 1. This piece is fixed to flask A by meshing or engaging of the shoulder 5 over a collar 12 on the neck of flask A.

In order to facilitate the centering and the preparation of the elements, one with relation with the others, the invention provides placing below the meshing collar or flange 12, vertical ribs 13 formed on the neck of flask A. In a first step, shoulder 5 is engaged in a temporary fashion on collar 12, as can be seen in FIG. 1. The result is to facilitate the mounting of the socket connector 1 over stopper 9 and the flask A and to render such mounting less expensive.

Naturally, it is possible to provide, in this modification, the various secondary features already illustrated in the aforementioned US patent, and especially a ball bearing imprisoned in the dropper and the socket, for avoiding a premature perforation of the airtight membrane.

Figure 3:
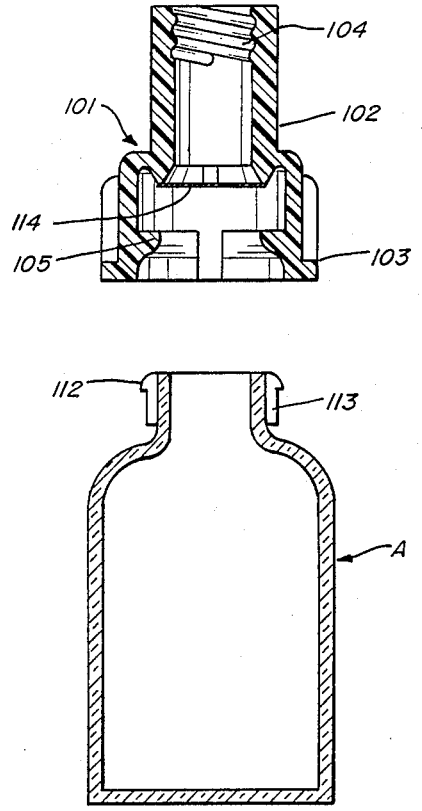
FIG. 3 is a similar view to FIG. 2 for the second embodiment of the invention, and, FIG. 4 is a top plan view of the connecting piece of FIG. 3.
Figure 4:
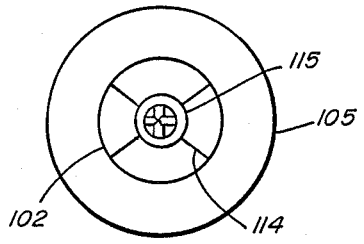

Referring now to FIGS. 3 and 4, these show flask A, containing the solid product to be put in solution and connecting piece 101, for placing it in communication with flask B containing the liquid product (not represented here). This piece 101 has an upper portion 102, presenting an interior threading 104, and lower portion 103, with inner shoulder 105, adapted to engage or snap-fit in accord with the invention with a small outer collar 112 on the neck of flask A.

According to the second embodiment here illustrated, the sealed stopper represented in 8-9-10 on FIG. 2 is eliminated and the closing of flask A is assured, when the connecting piece 101 is secured in place on flask A, by seal or cover 114, interposed between the upper portion 102 and the lower portion 103 of the piece 101.

It is the cover 114 which is perforated by the dropper of flask B when the neck of flask B is screwed in the threads 104; preferably brace 115 is provided in order to reinforce the cover.

It should be noted that in the case of the previous embodiment, the piece 101, when it is fitted on the neck of flask A, exerts over the closed stopper a pressure which assures its airtightness. On the contrary, in this second embodiment the communication between the two flasks A and B is made directly by the piece 101, which implies that the airtightness is assured by the closed cooperation between this piece and flask A, that is to say, by a fit as tight as possible.

According to a feature constituting a preferred embodiment, there can be provided between the two preassembled flasks a tearable flap forming a spacer.

This spacer prevents, at the start of the screwing, the downward movement of the dropper as far as the membrane, whose airtightening or hermetic sealing function is thus guaranteed. When the flap is torn, screwing can be continued to perforate the membrane with the dropper. Such a flap resembles that represented on 13-14 in the aforementioned US patent, but for the first time, is combined according to the invention, with an engageable connecting piece.

We claim:

1. An assembly for connecting a first, solid-containing flask having a neck portion with a second, compressible, liquid-containing flask, said second flask having an externally threaded neck portion and a pointed dropper associated with said threaded neck portion for introducing liquid from said second flask into said first flask and for then aspirating the resulting solution or suspension into said second flask, comprising, a generally cylindrical, integrally formed connector having an upper portion having an internal thread engaging said threaded neck portion of said second flask and receiving said dropper, said connector having a lower portion;

rupturable closing means formed inside and diametrically across said connector intermediate said upper and lower portions thereof and defining separate respective interior spaces in said connector portions, said closing means being formed in said integrally formed connector sufficiently close to said connector internal thread that said pointed dropper ruptures said closing means upon rotation of said externally threaded neck portion into said connector internal thread; and a collar formed around the neck portion of said first flask, said collar being frictionally fitted in said interior space of said lower portion of said connector, and having an outwardly extending upper part and vertically extending ribs engaging with said connector and thereby preventing undesired rotation of said collar during screwing of said second flask into said connector, said closing means having an enlarged upper portion resting on said upper part of said collar.

2. The assembly of claim 1, wherein said closing means includes a stopper having a central aperture closed by a membrane.

3. The assembly of claim 1, wherein said connector is molded.

4. An assembly for connecting a first, solid-containing flask having a neck portion with a second, compressible, liquid-containing flask, said second flask having an externally threaded neck portion and a pointed dropper associated with said threaded neck portion for introducing liquid from said second flask into said first flask and for then aspirating the resulting solution or suspension into said second flask, comprising, a generally cylindrical, integrally formed connector having an upper portion having an internal thread engaging said threaded neck portion of said second flask and receiving said dropper, said connector having a lower portion;

rupturable closing means formed inside and diametrically across said connector intermediate said upper and lower portions thereof and defining separate respective interior spaces in said connector portions, said closing means being formed in said integrally formed connector sufficiently close to said connector internal thread that said pointed dropper ruptures said closing means upon rotation of said externally threaded neck portion into said connector internal thread; and a collar formed around the neck portion of said first flask, having an outwardly extending upper part and vertically extending ribs engaging with said connector and thereby preventing undesired rotation of said collar during screwing of said second flask into said connector, said collar being frictionally fitted in said interior space of said lower portion of said connector, said lower portion of said connector having an inwardly extending peripheral shoulder snap-fitted over said outwardly extending part of said collar.

* * * * *